US011389921B2

(12) United States Patent
Klein et al.

(10) Patent No.: US 11,389,921 B2
(45) Date of Patent: Jul. 19, 2022

(54) HONING MACHINE

(71) Applicant: KADIA Produktion GmbH + Co., Nürtingen (DE)

(72) Inventors: Henning Klein, Stuttgart (DE); Roland Regler, Großbettlingen (DE); Uwe Moos, Mettlach-Bethingen (DE)

(73) Assignee: KADIA PRODUKTION GMBH + CO., Nürtingen (DE)

( * ) Notice: Subject to any disclaimer, the term of this patent is extended or adjusted under 35 U.S.C. 154(b) by 825 days.

(21) Appl. No.: 16/070,180

(22) PCT Filed: Dec. 21, 2016

(86) PCT No.: PCT/EP2016/082093
§ 371 (c)(1),
(2) Date: Jul. 13, 2018

(87) PCT Pub. No.: WO2017/121590
PCT Pub. Date: Jul. 20, 2017

(65) Prior Publication Data

US 2019/0001461 A1 Jan. 3, 2019

(30) Foreign Application Priority Data

Jan. 13, 2016 (DE) ..... 102016200295.3

(51) Int. Cl.
*B24B 33/02* (2006.01)
*B24B 33/08* (2006.01)

(52) U.S. Cl.
CPC ..... *B24B 33/02* (2013.01); *B24B 33/089* (2013.01)

(58) Field of Classification Search
CPC ... B24B 33/089; B24B 33/085; B24B 33/105; B24B 33/00; B24B 33/02
(Continued)

(56) References Cited

U.S. PATENT DOCUMENTS 2,268,028 A 12/1941 Fairbairn
3,126,672 A * 3/1964 Calvert et al. ..... B24B 33/02 451/150
(Continued)

FOREIGN PATENT DOCUMENTS

CH 158900 A 12/1932
CN 101443147 A 5/2009
(Continued)

OTHER PUBLICATIONS

Office Action issued in connection with corresponding German Patent Application No. 10 2016 200 295.3.
(Continued)

*Primary Examiner* — Tyrone V Hall, Jr.
*Assistant Examiner* — Makena S Markman
(74) *Attorney, Agent, or Firm* — Akerman LLP

(57) ABSTRACT

A honing machine (100) for honing bores in workpieces has honing spindle (170) which is mounted movably in a spindle housing (130), is rotatable about a spindle axis (172) by means of a rotary drive (150), is drivable in an oscillating manner parallel to the spindle axis by means of a lifting drive and, at a tool-side end, has a device for fastening a honing tool arrangement with an expandable honing tool. Furthermore, an expanding drive for expanding the honing tool is provided, wherein the expanding drive is connected to the spindle housing and is coupled to a feed rod (180) running in the interior of the honing spindle. The honing machine is characterized by a monocoque housing (150), which has a spindle housing portion (150-1), which serves as the spindle housing, for receiving the rotary drive (135), and an expanding system portion (150-2), which is formed integrally with the spindle housing portion, for receiving the expanding drive (155).

14 Claims, 2 Drawing Sheets

(58) Field of Classification Search
USPC .... 451/121, 66, 67, 461, 65, 68, 71, 70, 69, 451/180
See application file for complete search history.

(56) References Cited

U.S. PATENT DOCUMENTS

| | | | | |
|---|---|---|---|---|
| 8,287,214 | B2 * | 10/2012 | Sadaoka | B23D 77/042 408/36 |
| 9,931,727 | B2 * | 4/2018 | Regler | B24B 33/105 |
| 2001/0034196 | A1 * | 10/2001 | Hyatt | B24B 33/085 451/61 |
| 2006/0052038 | A1 * | 3/2006 | Klein | B23Q 5/10 451/11 |
| 2009/0129879 | A1 | 5/2009 | Sadaoka et al. | |
| 2010/0062692 | A1 * | 3/2010 | Tomita | B24B 33/027 451/61 |
| 2014/0345897 | A1 * | 11/2014 | Pelletier | B23Q 1/70 173/213 |

FOREIGN PATENT DOCUMENTS

| | | | |
|---|---|---|---|
| DE | 102 13 408 | A1 | 10/2003 |
| DE | 102 25 514 | A1 | 1/2004 |
| DE | 10 2011 108 982 | A1 | 2/2013 |
| DE | 102013109947 | A1 | 3/2015 |
| DE | 10 2013 112 834 | A1 | 5/2015 |
| DE | 102013226826 | A1 | 6/2015 |
| EP | 2 735 392 | A1 | 5/2014 |

OTHER PUBLICATIONS

International Search Report issued in connection with PCT/EP2016/082093.
Office Action issued in connection with corresponding Chinese Patent Application No. 201680083541.2, dated Dec. 4, 2019.

* cited by examiner

HONING MACHINE

CROSS-REFERENCE TO RELATED APPLICATIONS

This application is a national phase of PCT/EP2016/082093, filed Dec. 21, 2016, and claims priority to DE 10 2016 200 295.3, filed Jan. 13, 2016, the entire contents of which are hereby incorporated by reference.

TECHNICAL FIELD

Field of Use and Prior Art

The invention relates to a honing machine for honing bores in workpieces according to the preamble of claim 1.

BACKGROUND

Honing is a method of cutting by means of geometrically undefined cutters, in which a honing tool performs a cutting movement consisting of two components and there is constant surface contact between one or more cutting material bodies of the honing tool and the inner surface of the bore to be machined. The kinematics of an expandable honing tool are characterized by simultaneous execution of a rotational movement, an oscillating lifting movement proceeding in the axial direction of the bore, and an expanding movement, which leads to changing of the effective diameter of the honing tool. A surface structure with crossing machining traces is generally obtained on the inner surface of the bore. Surfaces finished by honing can meet extremely stringent requirements with respect to dimensional and geometrical tolerances, and therefore many sliding surfaces which are subjected to great loading in engines or engine components, for example cylinder liners in engine blocks, or inner surfaces of bores in housings of injection pumps, are machined by honing.

A honing machine suitable for honing is a machine tool, the working spindle of which is generally referred to as a honing spindle. The honing spindle is mounted movably in a spindle housing, is rotatable about its longitudinal center axis (spindle axis) by means of a rotary drive and is drivable in an oscillating manner parallel to the spindle axis by means of a lifting drive. At a tool-side end, the honing spindle has a device for fastening a honing tool arrangement with an expandable honing tool. There are various concepts for the expansion of the honing tool. An expanding drive for expanding the honing tool is frequently provided, wherein the expanding drive is connected to the spindle housing and acts via an expanding transmission on a feed rod which runs in the interior of the honing spindle and indirectly or directly brings about a radial displacement of cutting material bodies of the honing tool.

In order to optimize the economic efficiency and quality of honing methods, use is increasingly made of highly dynamic direct drives for lift and rotation, which permit honing at high lifting speeds (currently, for example, up to approx. 100 m/min) and rotational speeds (currently, for example, up to approx. 5000 rpm). There is a requirement for honing machines which, even under highly dynamic working conditions, meet the purpose sought.

For the highly dynamic movement of machine parts, direct drives are known, in particular in the embodiment in the form of a linear motor. DE 102 25 514 B4 describes a honing machine the lifting drive of which is a linear motor. Direct drives are distinguished by the potential for permitting high speeds and accelerations of the machine shaft driven therewith, with simultaneous friction-free generation of movement.

Problem and Solution

SUMMARY

The invention is based on the problem of providing a honing machine which permits economical manufacturing of honed workpieces with short cycle times and high quality.

To solve this problem, the invention provides a honing machine with the features of claim 1.

Advantageous developments are indicated in the dependent claims. The wording of all of the claims is incorporated into the contents of the description for reference.

A honing machine according to the claimed invention has a monocoque housing, which has a spindle housing portion, which serves as the spindle housing, for receiving the rotary drive, and an expanding system portion, which is formed integrally with the spindle housing portion, for receiving the expanding drive.

If the expanding drive is coupled to the feed rod via an expanding transmission in a manner transmitting movement, the expanding transmission is preferably also accommodated in the expanding system portion. There are also transmission-free expanding systems, for example those in which the expanding drive is a moving coil drive.

In comparison to conventional solutions with separate housings for rotary drive and expanding drive, a monocoque housing provides, inter alia, the possibility of a considerable saving on weight since, owing to the integrated design, some housing parts, flanges, fastening means, etc. can be omitted. This affords specific advantages particularly in honing machines. In honing machines, drives have to apply weight and acceleration forces in addition to the process forces. In particular in the case of highly dynamic machines and/or shaft movements running vertically, this leads to high driving powers having to be provided which generally, for their part, are again associated with an increase in the moving mass. A saving on weight provides considerably better conditions here.

In addition to the saving on weight, advantages arise in respect of the precision of the mutual orientation of expanding drive or expanding system and rotary drive and during the assembly. While, in the case of conventional honing machines, the expanding system has typically been manufactured as an assembly which is separate from the spindle housing and has been flange-mounted onto the spindle housing with the rotary drive with the aid of a connection flange, these assembly steps can be omitted when a monocoque housing is used. On account of the integrated housing design and the omission of connecting points between separate housings, there is also no longer the risk of the connections between separate housing parts being able to become loosened during prolonged alternating stress.

It is possible to produce the monocoque housing from a conventional steel material. However, further measures for reducing weight are preferably taken. A monocoque housing could be produced, for example, as an aluminum cast part (aluminum or aluminum alloy, e.g. Al—Mg). Embodiments in which the monocoque housing is produced as a lightweight component with the use of a lightweight construction material are regarded as particularly advantageous. If the monocoque housing which is movable together with the honing spindle is a lightweight component, i.e. a component produced using a lightweight construction material, then the moving mass can be significantly reduced in comparison to conventional solutions. A smaller moving mass has the effect that a higher acceleration of the mass is possible with the available force. This is advantageous in particular in the case of honing since here, during the lifting movement, there is an axial reciprocating movement component. The benefit becomes even clearer in the case of vertical honing machines since, in the case of a vertical arrangement of the axial movement, the reduction in the weight of the moving components has an additional positive effect on the dynamic behavior of the honing machine.

For many machining tasks, the amplitude of the axial movement is predetermined by external restrictions such as workpiece length. An increase in the maximum speed and in the acceleration in the reversing points of the lifting movement leads to an increased average axial speed. The axial speed often restricts the possible cutting speed and therefore the material removal which can be achieved. With increased axial speeds, ultimately shorter machining times and therefore shorter cycle times for a workpiece can therefore be achieved.

In conjunction with increased dynamics of moving machine parts, vibrations can also occur. The latter are generally undesirable since the machining quality drops due to this disturbing factor. By means of the use of suitable lightweight construction materials having high rigidity and good damping properties instead of solid components composed of steel or other conventional construction materials, undesirable vibrations can be more greatly damped, and therefore the machining result is improved.

A reduced moving mass can furthermore contribute to the lowering of the energy consumption of a machining machine, and therefore an increase in the energy efficiency arises here as an additional benefit.

According to a development, the monocoque housing is produced using a fiber composite material. Components which are producing using (at least) one fiber composite material can provide sufficient rigidity and good damping while having a very small mass. By means of the use of a fiber composite material for the production or during the production of a honing machine component movable together with the honing spindle, it is possible to considerably reduce the weight and the mass inertia of the corresponding component in comparison to a similarly configured and dimensioned component composed of a metallic material (for example steel material or aluminum material). At the same time, sufficient rigidity of the corresponding component can be ensured. By this means, the increase in the dynamics of the honing machining can be achieved without losses in terms of the quality.

A carbon fiber reinforced plastic (CFRP) is preferably used as the fiber composite material. In the case of such a fiber composite material, carbon fibers are embedded in a matrix composed of plastic (for example in an epoxy resin, in another thermosetting plastic or in a thermoplastic). The mechanical properties of the cured fiber composite material benefit here from the tensile strength of the carbon fibers. The plastic matrix prevents the fibers from being displaced in relation to one another under load and also contributes to the damping properties of the material. Alternatively or additionally, it is also possible, for example, to use a glass fiber reinforced plastic (GFRP) as the fiber composite material. Two or more fiber composite materials of different types can be combined during the production of a component which is movable together with the honing spindle.

A lightweight component produced with the use of a fiber composite material can be substantially completely composed of the fiber reinforced plastics material. In some cases, it is also possible to design the corresponding lightweight component in such a manner that it has a core of low mass density which is surrounded by a casing of fiber composite material. The movable mass can thereby be further reduced while the mechanical stability of the component at least remains the same. The core can be substantially composed, for example, of a pressure-stable lightweight material in which cavities are enclosed.

Alternatively or additionally, it is also possible to produce the monocoque housing and/or one or more other components movable together with the honing spindle with the use of a metal foam, for example an aluminum foam.

Furthermore, it is alternatively or additionally possible for the rotatably mounted honing spindle to be designed as a lightweight component.

In some embodiments, the lifting drive has a linear motor with a primary part fastened to a stand of the honing machine and a secondary part which is movable linearly in relation to the primary part and is integrated in a carriage carrying the spindle housing, wherein at least one component of the carriage is designed as a lightweight component. For example, the carriage can contain a carriage plate which is designed as a lightweight component.

In addition to the considerable advantages during the operation of the honing machine, advantages can also be obtained during the production. In some embodiments, it is provided that the lightweight component, in particular the monocoque housing, optionally also other components, is produced with the use of a close-to-final-shape production method which comprises at least one manufacturing step of laminating, foaming and/or 3D printing. Such production methods generally make do with relatively little material-removing finishing or entirely without material-removing finishing and permit a rapid and cost-effective production even of complex shapes.

The components of the honing machine are sometimes exposed during operation to considerable dynamic and static loads. In order to be able to withstand said loads permanently, it is provided, in preferred embodiments, that the lightweight component has an insert part which is not composed of a lightweight construction material at at least one connecting point for connecting the lightweight component to another component. The insert part can be substantially composed, for example, of steel, aluminum, magnesium, brass or titanium. By this means, stabilization of the lightweight component can be achieved, for example in the region of screw connections to adjacent components.

The possibility of producing even complex shapes rapidly and inexpensively with the aid of a lightweight construction material is made use of in some embodiments in that at least one through channel is formed in the lightweight component, said through channel leading from an input opening to an output opening, and through which through channel a flowable medium or at least one line is conducted or can be conducted. Such through channels can be provided, for example, in order to conduct cooling lubricant lines, pneumatic lines, electric lines and/or similar. If such lines are conducted through the interior of a lightweight component, they can be protected by the lightweight component against environmental influences and the entire honing machine furthermore gives a "tidy" impression. A through channel can also be directly used as a line for a flowable medium, for example a cooling liquid or cooling lubricant.

The honing machine can be configured as a horizontal honing machine (with a horizontally oriented honing spindle) or as a vertical honing machine (with a vertically oriented honing spindle). Particular advantages are afforded in the case of vertical honing machines since the influence of the weight on the lifting movement can also be reduced there by the use of lightweight components.

BRIEF DESCRIPTION OF THE DRAWINGS

Further advantages and aspects of the invention emerge from the claims and from the description below of preferred exemplary embodiments of the invention that are explained below with reference to the figures.

FIG. 1 shows some components of a honing machine according to a first exemplary embodiment of the invention, wherein

DETAILED DESCRIPTION OF THE EXEMPLARY EMBODIMENTS

Figure 1A:
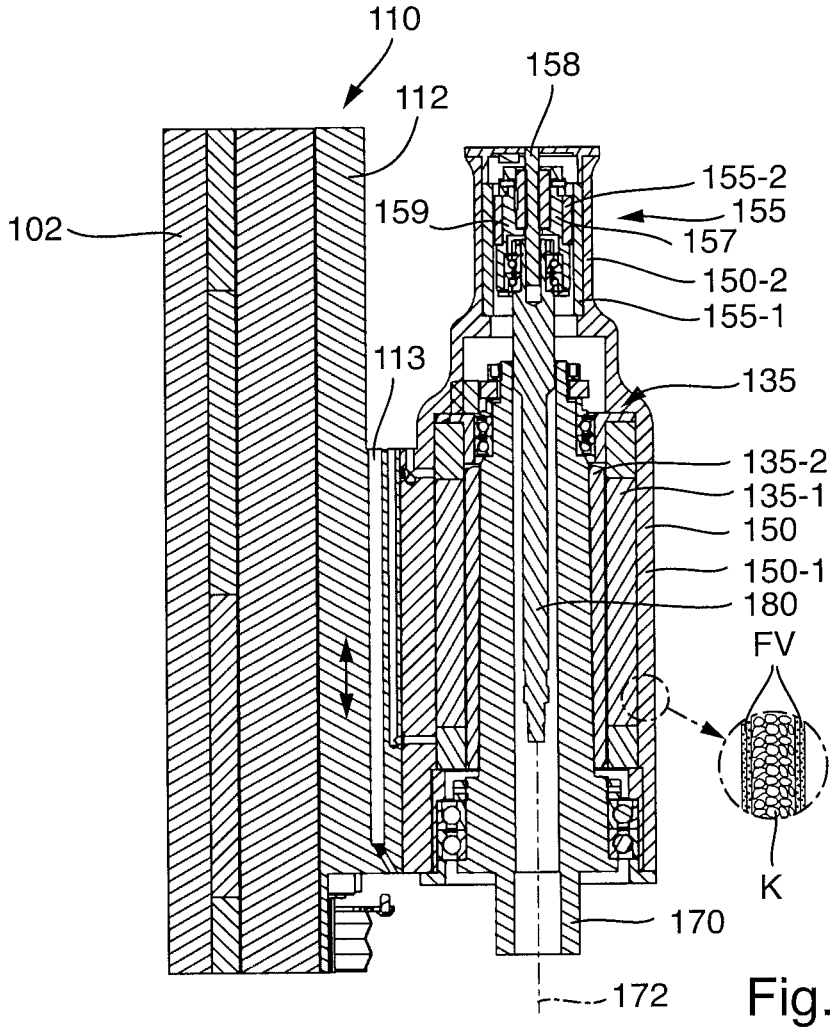
FIG. 1A shows a longitudinal section and FIG. 1B shows a vertical top view.

To facilitate the comprehension of improvements and advantages of honing machines according to the invention in comparison to the prior art, an example of a conventional honing machine 300 which can in principle be constructed in the manner described in DE 102 25 514 B4 is first of all explained with reference to FIG. 3. A workpiece 390, the bore 392 of which is intended to be honed with the aid of the honing tool 380, is clamped on a machining platform. The honing tool 380 is received into a cone at the lower end of a honing spindle 370 and, during operation of the honing machine, is moved up and down in a vertical lifting movement together with the honing spindle. The vertical movement component of the working movement of the honing tool is thereby carried out.

The honing spindle is mounted movably in a metallic spindle housing 330 and can be rotated about its spindle axis (longitudinal center axis) by means of a rotary drive in the form of an electric motor integrated in the spindle housing. The rotative component of the working movement of the honing tool is thereby produced.

The honing spindle is driven in an oscillating manner parallel to its spindle axis by means of a lifting drive. The lifting drive comprises an electric linear motor with a primary part fastened to a stand 302 of the honing machine and a secondary part which is movable linearly in relation to the primary part. The secondary part is integrated in a carriage 310 which is produced from steel and is guided in a linearly movable manner on a vertical guide device. The carriage 310 carries the spindle housing 330 which can therefore be moved vertically up and down together with the carriage. The secondary part here is the moving part and the primary part is the positionally fixed part of an electric linear motor.

An electric expanding drive which is coupled via an expanding transmission to a feed rod, which is guided in an axially movable manner in the interior of the honing spindle 370, is provided for the expansion of the expandable honing tool, i.e. for the change in the effective diameter of the honing tool. The metallic housing 350 which surrounds the expanding drive is flange-mounted onto the upper side of the spindle housing.

For the machining of the bore 392, the honing unit together with spindle housing 330 and honing spindle 370 and also the honing tool 380 accommodated therein is lowered to such an extent that the honing strips 382 of the honing tool enter the bore. The honing spindle 370 is then simultaneously moved to and fro (i.e. up and down) and rotated. The two working movements are coordinated with each other in such a manner that a cross-grinding pattern typical of honing arises on the inner surface of the machined bore.

The vertical carrier 302, and the running rails, which are mounted thereon, for the carriage 310, and the primary part of the linear motor belong to the positionally fixed components of the honing machine. The carriage 310 with the secondary part, which is integrated therein, of the linear motor and all of the components carried by the carriage belong to those components which are moved jointly in the honing spindle during the machining.

Figure 1B:
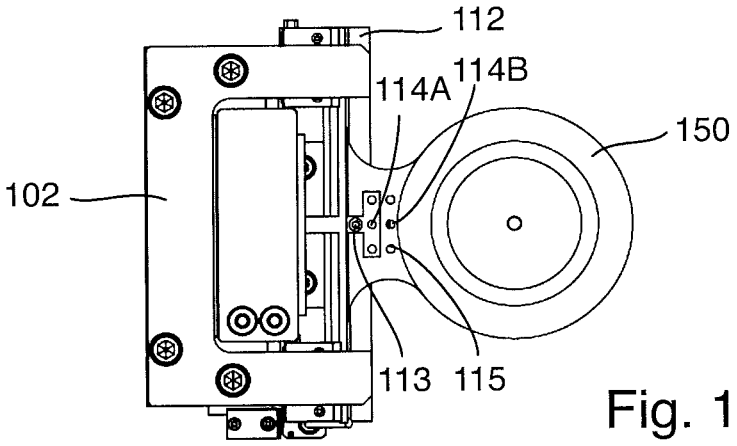

Exemplary embodiments of honing machines which are designed according to the claimed invention will now be described with reference to FIGS. 1A, 1B and 2. The positionally fixed components can be configured here in precisely the same manner as described in conjunction with FIG. 3. The honing tool and the devices for fastening the honing tool arrangement with an expandable honing tool to the tool-side end of the honing spindle can also be structurally similar or identical to those of the prior art. Important differences reside in the construction and partly in the configuration of components of the honing machine that are moved together with the honing spindle during the machining.

The honing spindle 170 of the exemplary embodiment is mounted rotatably within a housing 150 with the aid of rolling bearings in such a manner that it can rotate about its vertical spindle axis 172 in relation to the housing 150. The rotary drive 135 is designed as an electric direct drive and comprises a stator 135-1, which is mounted fixedly in the housing 150, and a rotor 135-2, which is mounted on the outer side of the honing spindle 170 and can rotate within the stator.

The honing spindle 170 has an inner through bore in which a feed rod 180 of the expanding system is guided in an axially movable manner. The feed rod rotates together with the honing spindle at the rotational speed thereof. The axial movement of the feed rod is brought about with the aid of an expanding drive 155 which is designed as an electric direct drive. A stator 155-1 of the expanding drive is mounted fixedly with respect to the housing 150. The rotor 155-2 which is rotatable in relation to the stator is coupled to a spindle nut 157, the internal thread of which interacts with the external thread of a threaded spindle 158 of the expanding drive. The threaded spindle 158 is fixedly mounted on a housing cover, which is connected fixedly to housing 150. During rotation of the rotor, the spindle nut runs along the threaded spindle, as a result of which the (shorter) rotor is axially moved axially in relation to the (longer) stator. The spindle nut is coupled to the feed rod via a receiving sleeve 159, which rotates with the spindle nut and is mounted rotatably in relation to the feed rod, in such a manner that the axial movement of the spindle nut is transmitted to the feed rod. Rotation of the rotor 155-2 of the expanding drive 155 in relation to the stator therefore brings about an axial movement of the feed rod 180 parallel to the spindle axis 172. Said feed can take place in a cyclical or regulated manner. The combination of spindle 158 and spindle nut 157 acts as an expanding transmission which converts the rotation of the rotor into an axial movement of the feed rod.

A particular characteristic consists in that the housing 150 essentially consists of a single component which serves both as a housing for the rotary drive 135 of the honing spindle 170 and as a housing for the expanding drive 155. For this purpose, the housing 150 has a spindle housing portion 150-1 which surrounds the stator 135-1 of the rotary drive 335 for the honing spindle, and also an expanding system portion 150-2 which is formed integrally with the spindle housing portion, is of a smaller diameter and serves, inter alia, for receiving the expanding drive 155. This integration of a plurality of components manufactured separately in the prior art and of components then mounted on one another in a single component is also referred to here as a monocoque housing 150.

Figure 3:
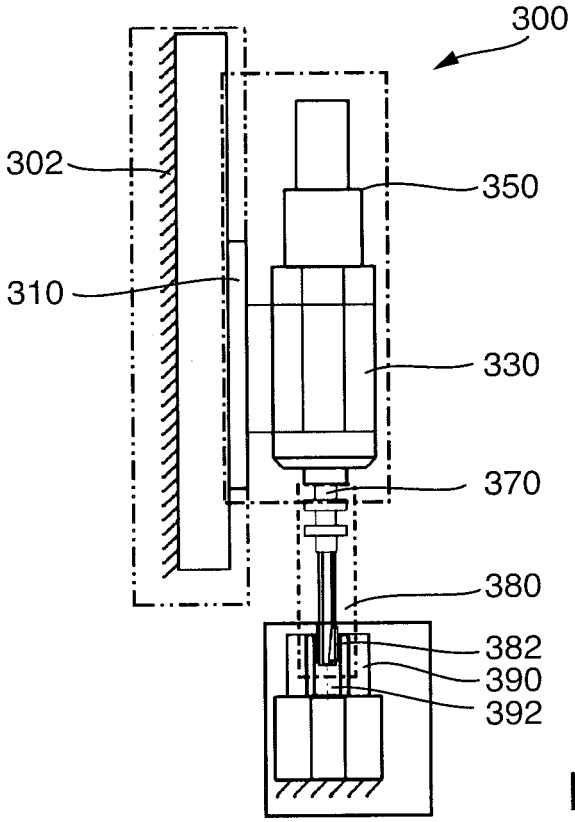
FIG. 3 schematically shows the design of a honing machine having a conventional design.

In comparison to the prior art according to FIG. 3, the interface between the housing of the spindle motor and the housing which is separate therefrom and surrounds the expanding drive and the expanding transmission is, inter alia, omitted. Potential error causes, such as, for example, the unintentional release of connections in the region of the interface during prolonged operation and possible misalignments during the alignment of expanding drive and spindle drive can therefore be avoided in principle.

A further particular characteristic resides in the fact that a plurality of components which are movable together with the honing spindle 170 are produced as lightweight components with the use of at least one lightweight construction material.

For example, the housing 150 (monocoque housing) is an integral, elongate hollow body, the wall portions of which are produced with the use of a fiber composite material, for example carbon fiber reinforced plastic (CFRP). The outer and inner walls of the monocoque housing are substantially composed here of fiber composite material FV which is laminated in a layered manner while a core K of lower mass density lies between the outer walls and is filled, for example, by a pressure-stable filler with glass beads or other rigid, light hollow bodies (see the enlargement of the detail in FIG. 1A). In comparison to a housing of identical dimension which is produced from steel material or another solid metallic material, this results in a considerable saving of weight with the rigidity at least remaining the same.

Furthermore, the carriage 110, which is guided linearly on the positionally fixed stand 102, while having the same dimension as a conventional carriage, is substantially lighter since the carriage plate 112 as a substantial component of the carriage is likewise produced as a lightweight component with the use of a fiber composite material. The components which are integrated therein, for example the secondary part of the linear motor for the lifting movement, can be configured as for the conventional honing machine.

A through channel 113 extends in the carriage plate 112, said through channel being continuous from the top to the bottom, through which through channel a cooling liquid for tool cooling can be conducted starting from an upper media connection (not illustrated). Furthermore, further through bores 114A, 114B run in the carriage plate 112 and in the monocoque housing, said through bores leading from an upper media connection through horizontal portions into the interior of the monocoque housing. Said through bores serve for supplying cooling liquid for cooling the rotary drive 135. Electric lines, for example for transmitters or sensors, can be conducted through further vertical through channels 115.

Figure 2:
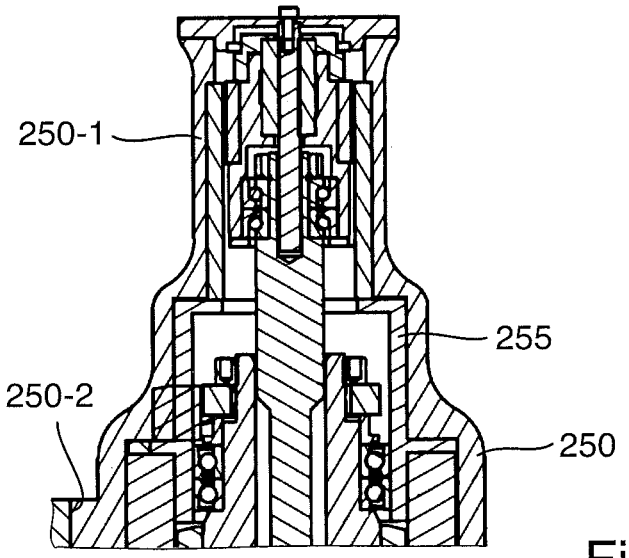
FIG. 2 shows a cutout of a honing machine according to a second exemplary embodiment of the invention.

The exemplary embodiment of FIG. 2 is constructed similarly or identically in most details to the exemplary embodiment of FIG. 1. One difference consists in the configuration of the inner contour of the monocoque housing 250 in the region of the transition between the expanding system portion 250-2 and the adjoining spindle housing portion 250-1 of larger diameter. In the exemplary embodiment of FIG. 1, the stator of the expanding drive is supported axially on an annular collar 156 which projects inward from the housing wall and surrounds a through opening for the feed rod. In order to produce said annular collar or said shoulder, two molds are used during the production of the exemplary embodiment, namely one mold which reaches from above the inner region as far as the shoulder (annular collar 156) and another mold which reaches from the lower passage opening for the honing spindle as far as the shoulder.

In the variant of FIG. 2, said annular collar is omitted, as a result of which it is possible to produce the monocoque housing 250 with only a single internal mold which can be introduced from the side of larger diameter and can also be removed on said side. In order to ensure the supporting function for the stator, it is provided, in the exemplary embodiment of FIG. 2, that that inner sleeve 255 which, inter alia, holds the upper rotary bearing of the honing spindle is continued in the direction of the smaller diameter and is drawn inward at the end such that a supporting surface for the stator is formed.

Some aspects of preferred exemplary embodiments can be described as follows.

The mass of some components of a honing spindle unit, which components are generally subjected to a movement, is reduced by the use of fiber composite materials and/or other lightweight construction materials. While drive and bearing components cannot be primarily realized in a composite material, the realizations in the form of composite material, for example glass fiber reinforced or carbon fiber reinforced plastic (GFRP/CFRP) are appropriate for housing and connecting components. Furthermore, foamed materials, such as metal foams (e.g. aluminum foam) in raw form, as sandwich components with cover plates or as filling material between the internal and external geometry are possible.

While steel has a density of approx. 7.85 g/cm$^3$, aluminum 2.71 g/cm$^3$, and titanium a density of 4.5 g/cm$^3$, the tensile strength, a measure of the mechanical load-bearing capacity of the material, is approx. 300-900 N/mm$^2$ for steel, approx. 60-500 N/mm$^2$ for aluminum, and approx. 300-1000 N/mm$^2$ for titanium.

Glass fiber composite materials have a tensile strength of, depending on the direction of the fibers, up to 1000 N/mm$^2$ at a density of approx. 2 g/cm$^3$. Carbon fiber composite materials have a tensile strength of up to 1400 N/mm$^2$ at a density of approx. 1.5 g/cm$^2$. Aramid fiber reinforced plastics have yet lower densities of approx. 1.4 g/cm$^3$ at similar tensile strengths to carbon fiber reinforced plastics. Aluminum foams in pure form have a density of ~0.5 g/cm$^3$. For composite and sandwich materials, approximately 1.0 g/cm$^3$ seems realistic.

A material-appropriate realization of the geometry of the components which are movable together with the honing spindle can contribute to exhausting the potential of lightweight construction materials during the construction of a honing spindle unit. This can mean, inter alia, that components can be configured to be as slender as possible and more material should be present only at points which absorb or dissipate forces.

The moving mass can be reduced by reducing connecting points and substituting screw connections, for example, with adhesive bonding connections or by laminating connecting parts into place. In the case of laminated or foamed components (such as, for example, GFRP, CFRP, aramid fibers, etc.), the use of fully metallic insert parts, for example made from the following materials: steel, aluminum, magnesium, brass or titanium, is possible for structural reasons in the region of connecting points.

In order to realize the lightweight concept, the use of the monocoque proposed in this application, i.e. of an integral housing body, is also possible. For example, a continuous tube is possible in which all of the components (spindle motor for generating the tool rotation, expanding transmission for active feeding and clamping/releasing of the tool in the machining spindle, etc.) and connecting elements and interfaces (cables, media) are integrated. As a result, the number of components used, and therefore also the mass, can be reduced.

Production close to the final shape gives the possibility of simply producing a mass-and-power-oriented machining unit with minimal finishing work, for example only at fitting points and screw-on surfaces, and subsequent installation of preassembled individual assemblies. By reducing the number of components, fewer interfaces are present, and therefore the probability of connections being released is reduced. The monocoque housing dissipates the occurring forces within the housing body in the best possible manner. These aspects increase the accuracy of the machining unit.

What is claimed is:

1. A honing machine for honing bores in workpieces, comprising:

a honing spindle which is rotatable about a spindle axis by means of a rotary drive, is drivable in an oscillating manner parallel to the spindle axis by means of a lifting drive, and, at a tool-side end, has a device for fastening a honing tool arrangement with an expandable honing tool, and an expanding drive for expanding the honing tool, wherein the expanding drive is coupled to a feed rod running in the interior of the honing spindle;

wherein the honing machine comprises a monocoque housing, wherein the monocoque housing is a single integral elongate hollow body comprising a spindle housing portion and an expanding system portion, wherein the expanding system portion of the monocoque housing is formed integrally with the spindle housing portion of the monocoque housing, wherein the rotary drive is positioned in the spindle housing portion of the monocoque housing and is designed as an electric direct drive comprising a stator which is mounted fixedly in the spindle housing portion of the monocoque housing, and further comprising a rotor which is mounted on the outer side of the honing spindle and can rotate within the stator; and the expanding drive is positioned in the expanding system portion of the monocoque housing and is designed as an electric direct drive comprising a stator of the expanding drive which is mounted fixedly with respect to the expanding system portion of the monocoque housing, and further comprising a rotor of the expanding drive which is rotatable in relation to the stator of the expanding drive and which is coupled to the feed rod so that a rotation of the rotor of the expanding drive relative to the stator of the expanding drive causes an axial movement of the feed rod parallel to the spindle axis.

2. The honing machine as claimed in claim 1, wherein the expanding drive is coupled to the feed rod via an expanding transmission, wherein the expanding transmission is accommodated in the expanding system portion.

3. The honing machine as claimed in claim 1, wherein the monocoque housing is produced as a lightweight component with the use of a lightweight construction material.

4. The honing machine as claimed in claim 3, wherein the lightweight construction material comprises a fiber composite material selected from the group consisting of a carbon fiber reinforced plastic and a glass fiber reinforced plastic.

5. The honing machine as claimed in claim 4, wherein the lightweight component produced with the use of the fiber composite material has a core of low mass density which is surrounded by a casing of the fiber composite material, wherein the core preferably substantially consists of a pressure-stable lightweight material in which cavities are enclosed.

6. The honing machine as claimed in claim 3, wherein the lightweight component is produced with the use of a close-to-final-shape production method which comprises at least one of the following steps: laminating; foaming; 3D printing.

7. The honing machine as claimed in claim 3, wherein the lightweight component has an insert part which is not composed of a lightweight construction material and at least one connecting point for connecting the lightweight component to another component, wherein the insert part is preferably substantially composed of steel, aluminum, magnesium, brass or titanium.

8. The honing machine as claimed in claim 3, wherein at least one through channel is formed in a lightweight component, said through channel leading from an input opening to an output opening, and through which through channel a flowable medium or at least one line is conducted or can be conducted.

9. The honing machine as claimed in claim 3, wherein the lightweight construction material is selected from the group consisting of a carbon fiber reinforced plastic, a glass fiber reinforced plastic, aluminum, and an aluminum alloy.

10. The honing machine as claimed in claim 1, wherein, in addition to the monocoque housing, at least one further component of the honing machine, which component is movable together with the honing spindle, is produced as a lightweight component with the use of a lightweight construction material, in particular a fiber composite material.

11. The honing machine as claimed in claim 1, wherein the lifting drive has a linear motor with a primary part fastened to a stand of the honing machine and a secondary part which is movable linearly in relation to the primary part and is integrated in a carriage carrying the spindle housing portion of the monocoque housing, wherein at least one component of the carriage is designed as a lightweight component.

12. The honing machine as claimed in claim 11, wherein the at least one component of the carriage comprises a carriage plate.

13. The honing machine as claimed in claim 1, wherein the honing machine is a vertical honing machine with a vertically oriented honing spindle.

14. The honing machine as claimed in claim 1, wherein the expanding system portion of the monocoque housing has a diameter which is smaller than a diameter of the spindle housing portion of the monocoque housing.

* * * * *